US009117446B2

(12) United States Patent
Bao et al.

(10) Patent No.: US 9,117,446 B2
(45) Date of Patent: Aug. 25, 2015

(54) METHOD AND SYSTEM FOR ACHIEVING EMOTIONAL TEXT TO SPEECH UTILIZING EMOTION TAGS ASSIGNED TO TEXT DATA

(75) Inventors: Shenghua Bao, Beijing (CN); Jian Chen, Beijing (CN); Yong Qin, Beijing (CN); Qin Shi, Beijing (CN); Zhiwei Shuang, Beijing (CN); Zhong Su, Beijing (CN); Liu Wen, Beijing (CN); Shi Lei Zhang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 925 days.

(21) Appl. No.: 13/221,953

(22) Filed: Aug. 31, 2011

(65) Prior Publication Data

US 2013/0054244 A1 Feb. 28, 2013

(30) Foreign Application Priority Data

Aug. 31, 2010 (CN) ..... 2010 1 0271135

(51) Int. Cl.
*G10L 13/08* (2013.01)
*G10L 13/10* (2013.01)

(52) U.S. Cl.
CPC *G10L 13/10* (2013.01); *G10L 13/08* (2013.01)

(58) Field of Classification Search
CPC ..... G10L 13/00; G10L 13/027; G10L 13/08; G10L 13/10
USPC ..... 704/9, 258, 260, 266, 268
See application file for complete search history.

(56) References Cited

U.S. PATENT DOCUMENTS

| | | | | |
|---|---|---|---|---|
| 5,860,064 | A | 1/1999 | Henton | |
| 6,847,931 | B2 | 1/2005 | Addison et al. | |
| 7,401,020 | B2 | 7/2008 | Eide | |
| 2004/0093207 | A1 * | 5/2004 | Ashley et al. | 704/223 |
| 2006/0069567 | A1 | 3/2006 | Tischer et al. | |
| 2006/0089833 | A1 * | 4/2006 | Su et al. | 704/230 |
| 2007/0208569 | A1 * | 9/2007 | Subramanian et al. | 704/270 |

(Continued)

FOREIGN PATENT DOCUMENTS

| | | |
|---|---|---|
| CN | 1874574 | 12/2006 |
| CN | 100539728 C | 9/2009 |

OTHER PUBLICATIONS

Saint-Aime, et al. "iGrace—Emotional Computational Model for Eml Companion Robot." Advances in Human-Robot Interaction, 2009, pp. 1-26.*

(Continued)

*Primary Examiner* — James Wozniak
(74) *Attorney, Agent, or Firm* — Fleit Gibbons Gutman Bongini & Bianco PL; Thomas Grzesik

(57) ABSTRACT

A method and system for achieving emotional text to speech. The method includes: receiving text data; generating emotion tag for the text data by a rhythm piece; and achieving TTS to the text data corresponding to the emotion tag, where the emotion tags are expressed as a set of emotion vectors; where each emotion vector includes a plurality of emotion scores given based on a plurality of emotion categories. A system for the same includes: a text data receiving module; an emotion tag generating module; and a TTS module for achieving TTS, wherein the emotion tag is expressed as a set of emotion vectors; and wherein emotion vector includes a plurality of emotion scores given based on a plurality of emotion categories.

18 Claims, 9 Drawing Sheets

(56) References Cited

U.S. PATENT DOCUMENTS

| | | | | |
|---|---|---|---|---|
| 2008/0059190 | A1 | 3/2008 | Chu et al. | |
| 2009/0063154 | A1* | 3/2009 | Gusikhin et al. | 704/260 |
| 2009/0248399 | A1* | 10/2009 | Au | 704/9 |
| 2009/0265170 | A1* | 10/2009 | Irie et al. | 704/236 |
| 2010/0262454 | A1* | 10/2010 | Sommer et al. | 705/10 |
| 2011/0112826 | A1* | 5/2011 | Wang et al. | 704/9 |
| 2011/0218804 | A1* | 9/2011 | Chun | 704/243 |
| 2011/0246179 | A1* | 10/2011 | O'Neil | 704/9 |

OTHER PUBLICATIONS

Danisman, Taner, et al. "Feeler: Emotion classification of text using vector space model." AISB 2008 Convention Communication, Interaction and Social Intelligence. vol. 1. 2008, pp. 53-59.*

Liu, Hugo, et al. "A model of textual affect sensing using real-world knowledge." Proceedings of the 8th international conference on Intelligent user interfaces. ACM, Jan. 2003, pp. 125-132.*

Mori, Shinya, Tsuyoshi Moriyama, and Shinji Ozawa. "Emotional speech synthesis using subspace constraints in prosody." Multimedia and Expo, 2006 IEEE International Conference on. IEEE, Jul. 2006, pp. 1093-1096.*

Neviarouskaya, et al. "Recognition of fine-grained emotions from text: An approach based on the compositionality principle." Modeling Machine Emotions for Realizing Intelligence. Springer Berlin Heidelberg, Jun. 2010. pp. 179-207.*

Tao, Jianhua. "Context based emotion detection from text input. "INTERSPEECH. 2004, pp. 1-4.*

Tao, Jianhua, et al. "Emotional Chinese talking head system."Proceedings of the 6th international conference on Multimodal interfaces. ACM, 2004, pp. 1-7.*

Vidrascu, et al. "Annotation and detection of blended emotions in real human-human dialogs recorded in a call center."Multimedia and Expo, 2005. ICME 2005. IEEE International Conference on. IEEE, Jul. 2005, pp. 1-4.*

Ma et al., "A continuous Chinese sign language recognition system," Automatic Face and Gesture Recognition, Fourth IEEE International Conference, vol.,No., pp. 428-433, 2000.

Sugimoto et al., "A Method for Classifying Emotion of Text Based on Emotional Dictionaries for Emotional Reading" AIA '06 Proceedings of the IASTED conference, 2006.

Sugimoto et al., "A method to classify emotional expressions of text and synthesize speech," First Int. Symposium on Control Communications and Signal Processing, 2004.

Zhu et al., "An HMM-based approach to automatic phrasing for Mandarin text-to-speech synthesis." COLING-ACL '06 Proceedings of the COLING/ACL on Main conference poster, 2006.

Yamagishi et al., "Model adaptation approach to speech synthesis with diverse voices and styles," In Proc. ICAASP, Hawaii, 2007, pp. 1233-1236.

* cited by examiner

METHOD AND SYSTEM FOR ACHIEVING EMOTIONAL TEXT TO SPEECH UTILIZING EMOTION TAGS ASSIGNED TO TEXT DATA

CROSS-REFERENCE TO RELATED APPLICATION

This application claims priority under 35 U.S.C. §119 from Chinese Patent Application No. 201010271135.3 filed Aug. 31, 2010, the entire contents of which are incorporated herein by reference.

BACKGROUND OF THE INVENTION

1. Field of the Invention

The Present Invention relates to a method and system for achieving Text to Speech. More particularly, the Present Invention is related to a method and system for achieving emotional Text to Speech.

2. Description of the Related Art

Text To Speech (TTS) refers to extracting corresponding speech units from an original corpus based on a result of rhythm modeling, adjusting and modifying a rhythm feature of the speech units by using specific speech synthesis technology, and finally synthesizing qualified speech. Currently, the synthesis level of several main speech synthesis tools have all come into practical stage.

It is well known that people can express a variety of emotion during reading, for example, during reading the sentence "Mr. Ding suffers severe paralysis since he is young, but he learns through self-study and finally wins the heart of Ms. Zhao with the help of network", the former half of which can be read with sad emotion, while the latter half of which can be read with joy emotion. However, the traditional speech synthesis technology will not consider the emotional information accompanied in the text content, that is, when performing speech synthesis, the traditional speech synthesis technology will not consider whether the emotion expressed in the text to be processed is joy, sad or angry.

Emotional TTS has become the focus of TTS research in recent years, the problem that has to be solved in emotional TTS research is to determine emotion state and establish association relationship between emotion state and acoustical feature of speech. The existing emotional TTS technology allows an operator to specify emotion category of a sentence manually, such as manually specify that the emotion category of sentence "Mr. Ding suffers severe paralysis since he is young" is sad, and the emotion category of sentence "but he learns through self-study and finally wins the heart of Ms. Zhao with the help of network" is joy, and process the sentence with the specified emotion category during TTS.

SUMMARY OF THE INVENTION

Accordingly, one aspect of the present invention provides a method for achieving emotional Text To Speech (TTS), the method includes the steps of: receiving text data; generating emotion tag for the text data by a rhythm piece; and achieving TTS to the text data corresponding to the emotion tag, where the emotion tags are expressed as a set of emotion vectors; where the emotion vector includes a plurality of emotion scores given based on a plurality of emotion categories.

Another aspect of the present invention provides a system for achieving emotional Text To Speech (TTS), including: a text data receiving module for receiving text data; an emotion tag generating module for generating an emotion tag for the text data by a rhythm piece; and a TTS module for achieving TTS to the text data according to the emotion tag, where the emotion tag is expressed as a set of emotion vectors; and where the emotion vector includes a plurality of emotion scores given based on a plurality of emotion categories.

DETAILED DESCRIPTION OF THE PREFERRED EMBODIMENT

In the following discussion, a large amount of specific details are provided to facilitate to understand the invention thoroughly. However, for those skilled in the art, it is evident that it does not affect the understanding of the invention without these specific details. It will be recognized that, the usage of any of following specific terms is just for convenience of description, thus the invention should not be limited to any specific application that is identified and/or implied by such terms.

There are unsolved problems in the existing emotional TTS technology. For example, firstly, since each sentence is assigned unified emotion category, the whole sentence is read with unified emotion, the actual effect of which is not natural and smooth; secondly, different sentences are assigned different emotion categories, therefore, there will be abrupt emotion change between sentences; thirdly, the cost of determining emotion of a sentence manually is high and is not adapted to perform batch process on TTS.

The present invention provides a method and system for achieving emotional TTS. The present invention can make TTS effect more natural and closer to real reading. In particular, the present invention generates emotion tag based on rhythm piece instead of whole sentence. The emotion tag in the present invention is expressed as a set of emotion vectors including a plurality of emotion scores given based on multiple emotion categories, which gives the rhythm piece in the present invention a more rich and real emotion expression instead of being limited to one emotion category. In addition, the present invention does not need manual intervention, that is, there is no need to specify a fixed emotion tag for each sentence manually. The present invention is applicable to various products that need to achieve emotional TTS, including E-books that can perform reading automatically, a robot that can perform interactive communication, and various TTS software that can read text content with emotion.

Figure 1:
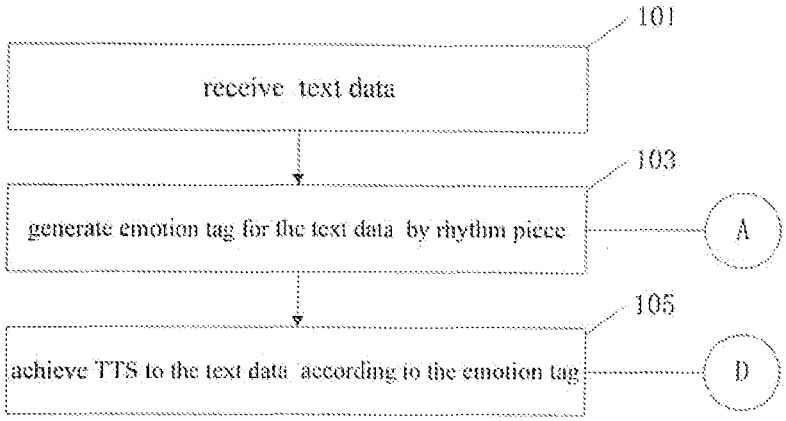
FIG. 1 shows a flowchart of a method for achieving emotional TTS according to an embodiment of the present invention.

FIG. 1 shows a flowchart of a method for achieving emotional TTS according to an embodiment of the present invention. Text data is received at step 101. The text data can be a sentence, a paragraph or a piece of article. The text data can be based on user designation (such as a paragraph selected by the user), or can be set by the system (such as answer to user enquiry by an intelligent robot). The text data can be Chinese, English or any other character.

An emotion tag for the text data is generated by rhythm piece at step 103, where the emotion tags are expressed as a set of emotion vectors. The emotion vector includes plurality of emotion scores given based on multiple emotion categories. The rhythm piece can be a word, vocabulary or a phrase. If the text data is in Chinese, according to an embodiment of the present invention, the text data can be divided into several vocabularies, each vocabulary being taken as a rhythm piece and an emotion tag is generated for each vocabulary. If the text data is English, according to an embodiment of the present invention, the text data can be divided into several words, each word being taken as a rhythm piece and an emotion tag is generated for each word. Of course, generally, the invention has no special limitation on the unit of rhythm piece, which can be a phrase with relatively coarse granularity, or it can be a word with relatively fine granularity. The finer the granularity is, the more delicate the emotion tag is. The final synthesis result will be closer to actual pronunciation, but computational load will also increase. The coarser the granularity is and the rougher the emotion tag is, the final synthesis result will have some difference to actual pronunciation. However, computational load will also be relatively low in TTS.

TTS to the text data is achieved according to the emotion tag at step 105. The present invention will use one emotion category for each rhythm piece, instead of using a unified emotion category for one sentence to perform synthesis. When achieving TTs, the present invention considers a degree of each rhythm on each emotion category. The present invention considers the emotion score under each emotion category, in order to realize TTS that is closer to create an actual speech effect. The detailed content will be described below in detail.

Figure 2A:
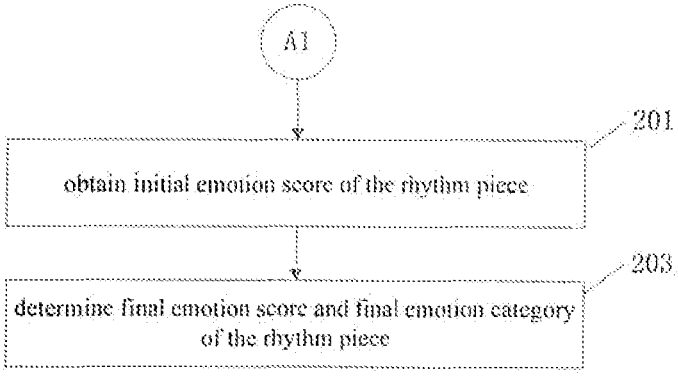
FIG. 2A shows a flowchart of a method for generating emotion tag for the text data in FIG. 1 by rhythm piece according to an embodiment of the present invention.

FIG. 2A shows a flowchart of a method for generating an emotion tag for the text data and rhythm piece shown in FIG. 1 according to an embodiment of the present invention. Initial emotion score of the rhythm piece is obtained at step 201. For example, types of emotion categories can be defined, where the types includes neutral, happy, sad, moved, angry and uneasiness. The present invention, however, is not only limited to the above manner for defining emotion category. For example, if the received text data is "Don't feel embarrassed about crying as it helps you release these sad emotions and become happy" and the sentence is divided into 16 words, the present invention takes each word as a rhythm piece. Initial emotion score of each word is shown at step 201, as shown in Table 1 below. To save space, Table 1 omits the emotion score of six intermediate words.

TABLE 1

| | Don't | feel | embarrassed | about | crying | . . . | sad | emotions | and | become | happy |
|---|---|---|---|---|---|---|---|---|---|---|---|
| neutral | 0.20 | 0.40 | 0.00 | 1.00 | 0.10 | | 0.05 | 0.50 | 1.00 | 0.80 | 0.10 |
| happy | 0.10 | 0.20 | 0.00 | 0.00 | 0.20 | | 0.00 | 0.10 | 0.00 | 0.05 | 0.80 |
| sad | 0.20 | 0.10 | 0.00 | 0.00 | 0.30 | | 0.85 | 0.00 | 0.00 | 0.05 | 0.00 |
| moved | 0.00 | 0.20 | 0.00 | 0.00 | 0.05 | | 0.00 | 0.20 | 0.00 | 0.05 | 0.1 |
| angry | 0.30 | 0.00 | 0.20 | 0.00 | 0.35 | | 0.05 | 0.10 | 0.00 | 0.05 | 0.00 |
| uneasiness | 0.20 | 0.10 | 0.80 | 0.00 | 0.00 | | 0.05 | 0.10 | 0.00 | 0.00 | 0.00 |

As shown in Table 1, emotion vector can be expressed as an array with emotion scores. According to an embodiment of the present invention, normalization process can be performed on each emotion score. In the array with emotion scores for each rhythm piece, the sum of six emotion scores is 1.

The initial emotion score in Table 1 can be obtained in a variety of ways. According to an embodiment of the present invention, the initial emotion score can be a value that is given manually, where a score is given to each emotion category. For a word that has no initial emotion score, a default initial emotion score can be set as shown in Table 2 below.

TABLE 2

| | Friday |
|---|---|
| neutral | 1.00 |
| happy | 0.00 |
| sad | 0.00 |
| moved | 0.00 |
| angry | 0.00 |
| uneasiness | 0.00 |

According to another embodiment of the present invention, emotion categories in a large number of sentences can be marked. For example, emotion category of sentence "I feel so frustrated about his behavior at Friday" is marked as "angry", emotion category of sentence "I always go to see movie at Friday night" is marked as "happy". Furthermore, statistic collection can be performed on the emotion category occurred at each word within the large number of sentences.

For example, "Friday" has been marked as "angry" for 10 times while been marked as "happy" for 90 times. Distribution of emotion score for word "Friday" is as shown in Table 3.

TABLE 3

| | Friday |
|---|---|
| neutral | 0.00 |
| happy | 0.90 |
| sad | 0.00 |
| moved | 0.00 |
| angry | 0.10 |
| uneasiness | 0.00 |

According to another embodiment of the present invention, the initial emotion score of the rhythm piece can be updated using the final emotion score obtained in prior step of the invention. As a result, the updated emotion score can be stored as initial emotion score. For example, the word "Friday" itself can be a neutral word. If the word "Friday" has been found through step many sentences have expressed a happy emotion when they refer to "Friday", the initial emotion score of the word "Friday" can be updated from the final emotion score.

Final emotion score and final emotion category of the rhythm piece are determined at step 203. According to an embodiment of the present invention, a highest value in the multiple initial emotion scores can be determined as a final emotion score, and an emotion category represented by the final emotion score can be taken as a final emotion category. For example, the final emotion score and the final emotion category of each word in Table 1 are determined as shown in Table 4.

TABLE 4

| | Don't | feel | embarrassed | about | crying | . . . | sad | emotions | and | become | happy |
|---|---|---|---|---|---|---|---|---|---|---|---|
| neutral | | 0.40 | | 1.00 | | | | 0.50 | 1.00 | 0.80 | |
| happy | | | | | | | | | | | 0.80 |
| sad | | | | | | | 0.85 | | | | |
| moved | | | | | | | | | | | |
| angry | 0.30 | | | | 0.35 | | | | | | |
| uneasiness | | | 0.80 | | | | | | | | |

As shown in Table 4, the final emotion score of "Don't" is 0.30 and its final emotion category is "angry".

Figure 2B:
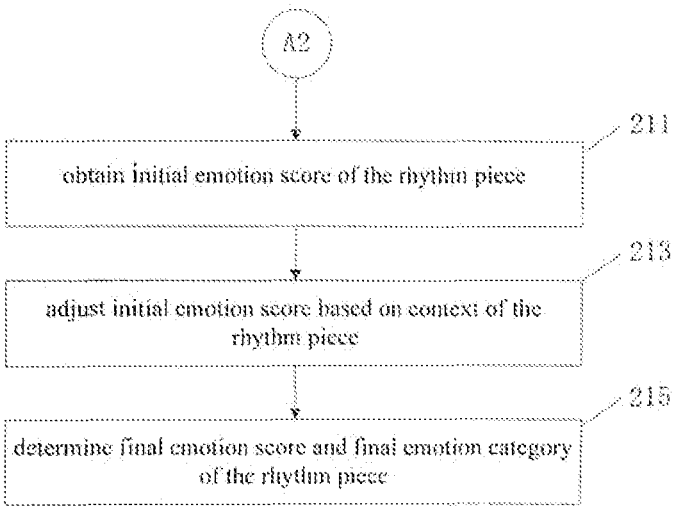
FIG. 2B shows a flowchart of a method for generating emotion tag for the text data in FIG. 1 by rhythm piece according to another embodiment of the present invention.

FIG. 2B shows a flowchart of a method for generating emotion tag by using the rhythm piece according to another embodiment of the present invention. The embodiment in FIG. 2B generates emotion tag of each word based on context of a sentence, so the emotion tag in that embodiment can comply with semantic. Firstly, initial emotion score of the rhythm piece is obtained at step 211, where the process is similar to that shown in FIG. 2A. The initial emotion score is then adjusted based on context of the rhythm piece at step 213. According to an embodiment of the present invention, initial emotion score can be adjusted based on an emotion vector adjustment decision tree, where the emotion vector adjustment decision tree is established based on emotion vector adjustment training data.

Figure 5:
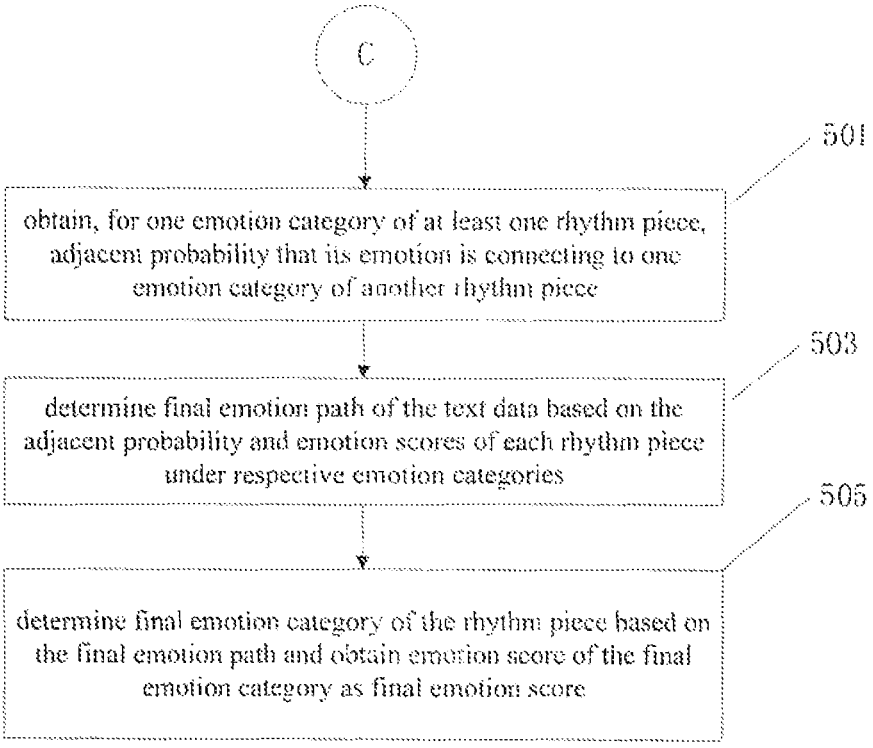
FIG. 5 shows a flowchart of a method for applying emotion smoothing to the text data in FIG. 3 according to an embodiment of the present invention.

The emotion vector adjustment training data can be a large amount of text data where emotion score had been adjusted manually. For example, for the sentence "Don't be shy", the established emotion tag is as shown in FIG. 5.

TABLE 5

| | Don't | be | shy |
|---|---|---|---|
| neutral | 0.20 | 1.00 | 0.00 |
| happy | 0.00 | 0.00 | 0.00 |
| sad | 0.10 | 0.00 | 0.00 |
| moved | 0.00 | 0.00 | 0.00 |
| angry | 0.50 | 0.00 | 0.00 |
| uneasiness | 0.20 | 0.00 | 1.00 |

Based on the context of the sentence, initial emotion score of the above sentence is adjusted manually. The adjusted emotion score is shown in Table 6:

TABLE 6

| | Don't | be | shy |
|---|---|---|---|
| neutral | 0.40 | 0.40 | 0.40 |
| happy | 0.00 | 0.10 | 0.00 |
| sad | 0.20 | 0.20 | 0.00 |
| moved | 0.00 | 0.20 | 0.20 |
| angry | 0.20 | 0.00 | 0.00 |
| uneasiness | 0.20 | 0.10 | 0.40 |

As shown in Table 6, the emotion score of "neutral" for word "Don't" has been increased and the emotion score of "angry" has been decreased. The data shown in Table 6 is from the emotion vector adjustment training data. The emotion vector adjustment decision tree can be established based on the emotion vector adjustment training data, so that some rules for performing manual adjustment can be summarized and recorded. The decision tree is a tree structure obtained by performing analysis on the training data with certain rules. A decision tree generally can be represented as a binary tree, where a non-leaf node on the binary tree can either be a series of problems from the semantic context (these problems are conditions for adjusting emotion vector), or can be an answer between "yes" and "no". The leaf node on the binary tree can include implementation schemes for adjusting emotion score of rhythm piece, where these implementation schemes are the result of emotion vector adjustment.

Figure 2C:
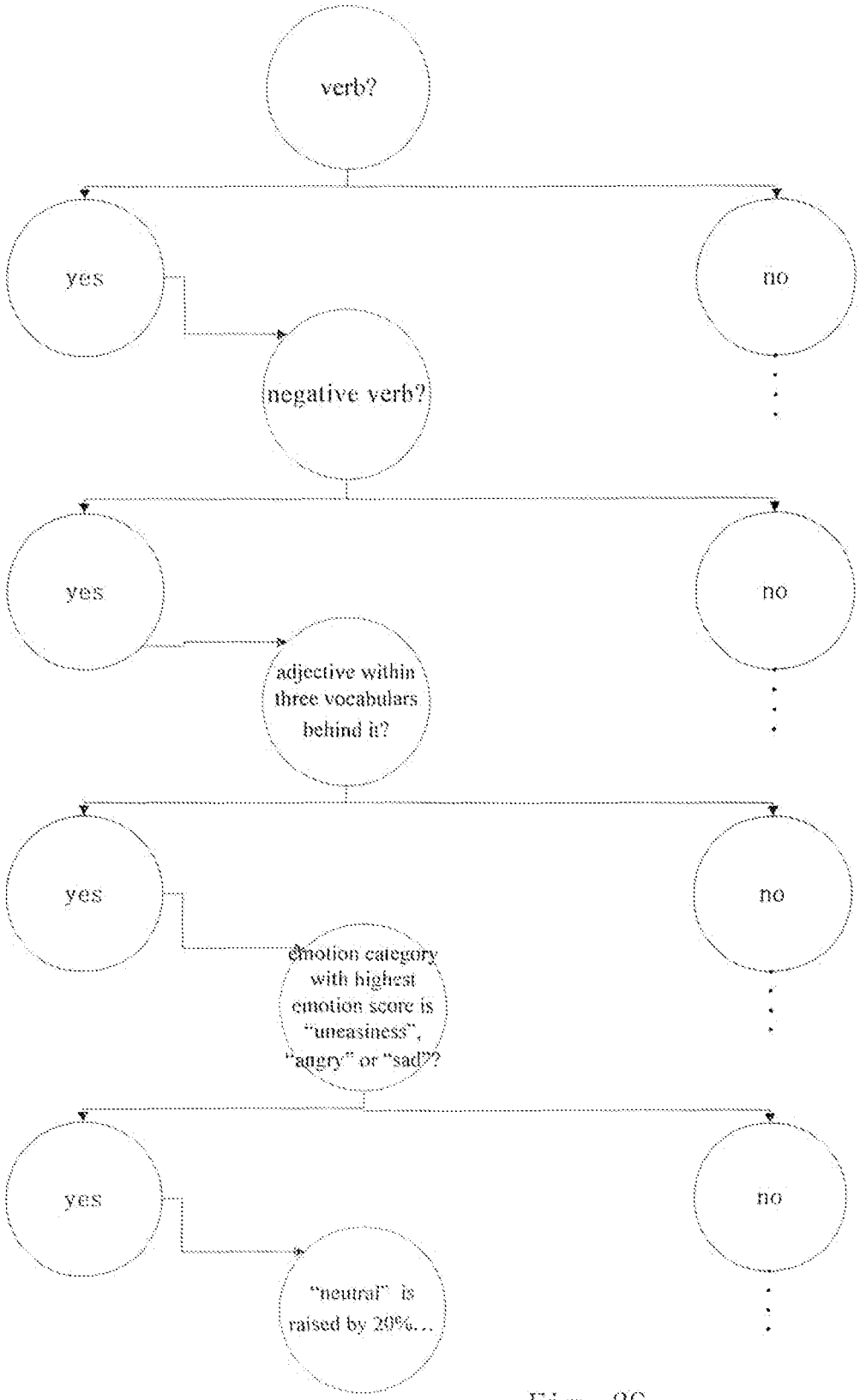
FIG. 2C is a diagram showing a fragment of an emotion vector adjustment decision tree.

FIG. 2C is a diagram showing a fragment of an emotion vector adjustment decision tree. First, it is judged whether a word to be adjusted (e.g., "Don't") is a verb. If the word is a verb, it is further judged whether it is a negative verb. If not, then other decisions are made. If it is a negative verb, then it is further judged whether there is an adjective within three words behind the verb (e.g., "Don't" is a negative verb). If not, then other decisions are made. If there is an adjective within three words behind the verb (e.g., a second vocabulary behind "Don't" is an adjective "shy"), then it is further decided if the adjective has the emotion category that includes one of "uneasiness", "angry" or "sad". If there is no adjective within three vocabularies behind it, then other decisions are made. If the emotion category of the adjective is one of "uneasiness", "angry" or "sad", then emotion score in each emotion category is adjusted according to the result of adjusting emotion score. For example, emotion score for "neutral" emotion category is raised by 20% (for example, emotion score of "Don't" in emotion vector adjustment training data is raised from 0.20 to 0.40), and emotion scores of other emotion categories are correspondingly adjusted. The emotion vector adjustment decision tree established by a large amount of emotion vector adjustment training data can automatically summarize the adjustment result, and the emotion vector adjustment tree should perform under certain conditions. FIG. 2C is a diagram showing a fragment of an emotion vector adjustment decision tree. In the present embodiment of the present invention, more can be decided by the decision tree as an emotion adjustment condition. The decisions can also relate to a part of speech, such as a decision involving a noun or an auxiliary word. The decisions can also related to an entity, such as a decision involving a person's name, an organization's name, an address name, or etc. The decisions can also relate to a position, such as a decision involving a location of a sentence. The decisions can also be sentence pattern related, where the decision decides whether a sentence is a transition sentence, a compound sentence, or etc. The decisions can also be distance related, where the decision decides whether a vocabulary with other part of speech appears within several vocabularies etc. In summary, implementation schemes for adjusting emotion score of rhythm piece can be summarized and recorded by judging a series of problems about semantic context. After these implementation schemes are recorded, the new text data "Don't feel embarrassed . . . " is entered into emotion vector adjustment decision tree. A traversal then can be performed according to a similar process and the implementation schemes recorded in a leaf node for adjusting emotion score. The traversal can also be applied to the new text data. For example, after traversing vocabularies "Don't" in "Don't feel embarrassed . . . ," the vocabularies enter into leaf node in FIG. 2C, and emotion score for vocabulary "Don't" with "neutral" emotion category can be raised by 20%. With the above adjustment, the adjusted emotion score can be closer with the context of the sentence.

In addition to using the emotion vector adjustment decision tree to adjust the emotion score, the original emotion score can also be adjusted according to a classifier based on the emotion vector adjustment training data. The working principle of classifier is similar to that of emotion vector adjustment decision tree. The classifier, however, can statistically collect changes in emotion scores under an emotion category, and apply the statistical result to new entered text data to adjust the original emotion score. For example, some known classifiers are Support Vector Machine (SVM) classification technique, Naïve Bayes (NB) etc.

Finally, the process returns to FIG. 2B, where final emotion score and final emotion category of the rhythm piece are determined based on respective adjusted emotion scores shown in step 215.

Figure 3:
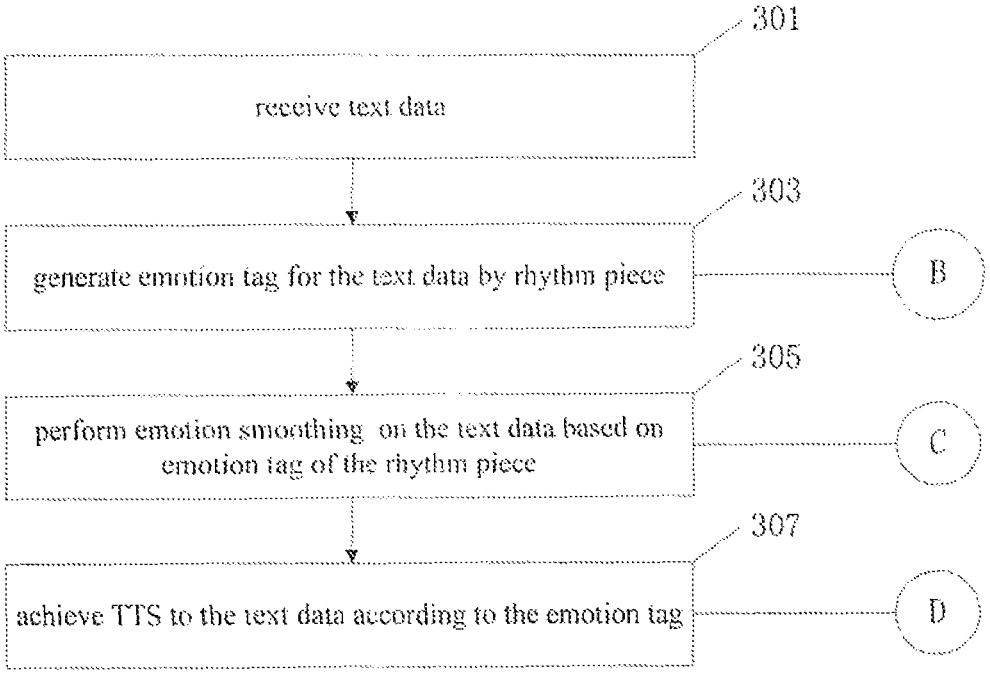
FIG. 3 shows a flowchart of a method for achieving emotional TTS according to another embodiment of the present invention.

FIG. 3 shows a flowchart of a method for achieving emotional TTS according to another embodiment of the present invention. Text data is received at step 301. An emotion tag for the text data is generated by a rhythm piece at step 303. Emotion smoothing can prevent emotion category from jumping, which can be caused by a variation in final emotion scores of different rhythm pieces. As a result, a sentence's emotion transition will be smoother and more natural, and the effect of TTS will be closer to real reading effect. Next, a description will be given, which performs emotion smoothing on one sentence. However, the present invention is not only limited to perform emotion smoothing on one full sentence, but the present invention can also perform emotion smoothing on a portion of sentence or on a paragraph. Emotion smoothing is performed on the text data based on the emotion tag of the rhythm piece at step 305. Finally, TTS to the text data is achieved according to the emotion tag at step 307.

Figure 4A:
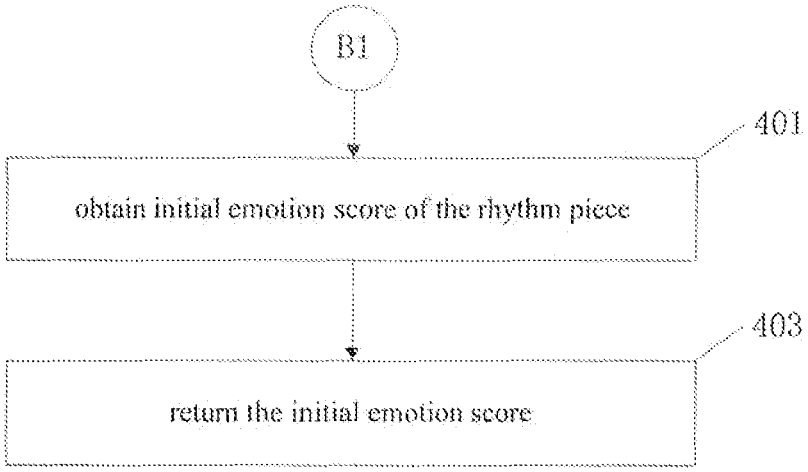
FIG. 4A shows a flowchart of a method for generating emotion tag for the text data in FIG. 3 by rhythm piece according to an embodiment of the present invention.

FIG. 4A shows a flowchart of a method for generating emotion tag for the text data in FIG. 3 by utilizing a rhythm piece according to an embodiment of the present invention. The method flowchart in FIG. 4A corresponds to FIG. 2A, where initial emotion score of the rhythm piece is obtained at step 401 and the initial emotion score is returned at step 403. The detailed content of step 401 is identical to that of step 201. In the embodiment shown in FIG. 3, the step of performing emotion smoothing on the text data will be carried out with another step of determining final emotion score and final emotion category of the rhythm piece. In step 403, the initial emotion score in emotion vector of the rhythm piece is returned (as shown in table 1), rather than determining final emotion score and final emotion category for TTS.

Figure 4B:
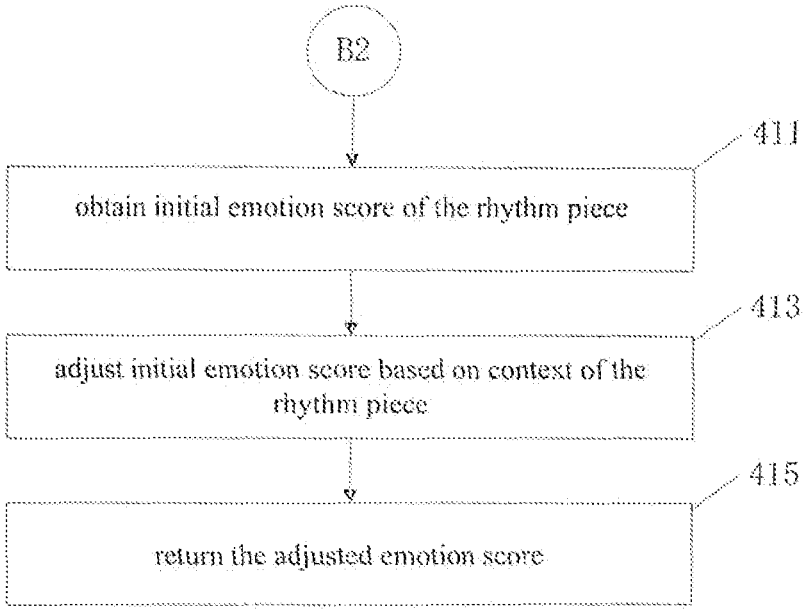
FIG. 4B shows a flowchart of a method for generating emotion tag for the text data in FIG. 3 by rhythm piece according to another embodiment of the present invention.

FIG. 4B shows a flowchart of a method for generating emotion tag for the text data by rhythm piece according to another embodiment of the present invention. The method flowchart in FIG. 4B corresponds to FIG. 2B: where initial emotion score of the rhythm piece is obtained at step 411; the initial emotion score is adjusted based on context semantic of the rhythm piece at step 413; and the adjusted initial emotion score is returned at step 415. The content of steps 411, 413 are similar to steps 211, 213. In the embodiment shown in FIG. 3, the step of performing emotion smoothing on the text data based on emotion tag of the rhythm piece is with the step of determining final emotion score and final emotion category of the rhythm piece. In step 415, the initial emotion score in adjusted emotion vector of the rhythm piece (i.e. a set of emotion score) is returned, rather than using the initial emotion score to determine final emotion score and final emotion category for TTS.

FIG. 5 shows a flowchart of a method of applying emotion smoothing to the text data according to another embodiment of the present invention. Emotion adjacent training data is used in the flowchart, the emotion adjacent training data includes a large number of sentences in which emotion categories are marked. As an example, the emotion adjacent training data is shown in Table 7 below:

TABLE 7

| | | | | | | |
|---|---|---|---|---|---|---|
| Mr. | Ding | suffers | severe | paralysis | since | he |
| neutral | neutral | sad | sad | sad | neutral | neutral |
| is | young | , | but | he | learns | through |
| neutral | neutral | | neutral | neutral | happy | neutral |
| self-study | and | finally | wins | the | heart | of |
| happy | neutral | neutral | happy | neutral | moved | neutral |
| Ms. | Zhao | with | the | help | of | network |
| neutral | neutral | neutral | neutral | happy | neutral | neutral |

The marking of the emotion category in Table 7 can be manually marked, or it can be automatically expanded based on manually marked marking of the emotion category. The expansion to the emotion adjacent training data will be described in detail below. There can be a variety of ways for marking, and marking in form of a list shown in Table 7 is one of the ways. In other embodiments, colored blocks can be set to represent different emotion categories, and a marker can mark the word in the emotion adjacent training data by using pens with different colors. Furthermore, default value such as "neutral" can be set for unmarked words, such that emotion categories of the unmarked words are all set as "neutral".

The information as shown in Table 8 below can be obtained by performing statistic collection on emotion category adjacent condition of a word in a large amount of emotion adjacent training data.

TABLE 8

| | neutral | happy | sad | moved | angry | uneasiness |
|---|---|---|---|---|---|---|
| neutral | 1000 | 600 | 700 | 600 | 500 | 300 |
| happy | 600 | 800 | 100 | 700 | 100 | 300 |
| sad | 700 | 100 | 700 | 500 | 500 | 200 |
| moved | 600 | 700 | 500 | 600 | 100 | 200 |
| angry | 500 | 100 | 500 | 100 | 500 | 300 |
| uneasiness | 300 | 300 | 200 | 200 | 300 | 400 |

Table 8 shows that in the emotion adjacent training data, the number "1000" corresponds to two emotion categories that are marked "neutral," where "1000" represent the numbers of words that are adjacent to each other. Similarly, the number "600" corresponds to two emotion categories, where one emotion category is marked "happy" and another emotion category is marked "neutral."

Table 8 can be a 7×7 table that marks the number of times of words that are adjacent to each other, but can be a table with higher dimensions. According to an embodiment of the present invention, the adjacent data does not consider the order of words of two emotion categories appeared in emotion adjacent training data. Thus, the recorded number that corresponds to "happy" column and "neutral" row is identical to the recorded number that corresponds to "happy" row and "neutral" column.

According to another embodiment of the present invention, when performing a statistic collection on the number of adjacent words with emotional categories, the order of words of two emotion categories is considered, and thus the recorded number of adjacent times that corresponds with "happy" column and "neutral" row can not be identical to that the recorded number that corresponds with "happy" row and "neutral" column.

Next, adjacent probability of two emotion categories can be calculated with the following formula 1:

$$p(E_1, E_2) = \frac{num(E_1, E_2)}{\sum_i \sum_j num(E_i, E_j)} \quad \text{formula 1}$$

Where: $E_1$ represents one emotion category; $E_2$ represents another emotion category; $num(E_1, E_2)$ represents the number of adjacent times of $E_1$ and $E_2$;

$$\sum_i \sum_j num(E_i, E_j)$$

represents the sum of number of adjacent times of any two emotion categories; and $p(E_1, E_2)$ represents adjacent probability of word of these two emotion categories. The adjacent probability is obtained by performing a statistical analysis on emotion adjacent training data, the statistical analysis including: recording the number of times at least two emotion categories adjacent in the emotion adjacent training data.

Furthermore, the present invention can perform normalization process on $P(E_1, E_2)$, such that the highest value in $P(E_i, E_j)$ is 1, when other $P(E_i, E_j)$ is a relative number, i.e. a smaller number than 1. The normalized adjacent probability of words having two emotion categories is calculated, and can be shown on a table. See Table 9.

TABLE 9

| | neutral | happy | sad | moved | angry | uneasiness |
|---|---|---|---|---|---|---|
| neutral | 1.0 | 0.6 | 0.7 | 0.6 | 0.5 | 0.3 |
| happy | 0.6 | 0.8 | 0.1 | 0.7 | 0.1 | 0.3 |
| sad | 0.7 | 0.1 | 0.7 | 0.5 | 0.5 | 0.2 |
| moved | 0.6 | 0.7 | 0.5 | 0.6 | 0.1 | 0.2 |
| angry | 0.5 | 0.1 | 0.5 | 0.1 | 0.5 | 0.3 |
| uneasiness | 0.3 | 0.3 | 0.2 | 0.2 | 0.3 | 0.4 |

Based on Table 9, for one emotion category of at least one rhythm piece, adjacent probability that one emotion category is connected to an emotion category of another rhythm piece can be obtained at step 501. For example, adjacent probability between "Don't," which has a "neutral" emotion category, and "feel," which has a "neutral" emotion category, has a value of 1.0. In another example, adjacent probability of the word "Don't" in "neutral" emotion category and the word "feel" in "happy" emotion category is 0.6. Adjacent probability between a word in one emotion category and another word having another emotion category can be obtained.

Final emotion path of the text data is determined based on the adjacent probability and emotion scores of respective emotion categories at step 503. For example, for sentence "Don't feel embarrassed about crying as it helps you release these sad emotions and become happy", assuming Table 1 has listed emotion tag of that sentence marked in step 303, a total of $6^{16}$ emotion paths can be described based on all adjacent probabilities obtained in step 501. The path with the highest sum of adjacent probability and the highest sum of emotion score can be selected from these emotion paths at step 503 as final emotion path, as shown in Table 10 below.

TABLE 10

| | Don't | feel | embarrassed | about | crying | . . . | sad | emotions | and | become | happy |
|---|---|---|---|---|---|---|---|---|---|---|---|
| neutral | 0.2 | 0.4 | 0 | 1 | 0.1 | | 0.05 | 0.5 | 1 | 0.8 | 0.1 |
| happy | 0.1 | 0.2 | 0 | 0 | 0.2 | | 0 | 0.1 | 0 | 0.05 | 0.8 |
| sad | 0.2 | 0.1 | 0 | 0 | 0.3 | | 0.85 | 0 | 0 | 0.05 | 0 |
| moved | 0 | 0.2 | 0 | 0 | 0.05 | | 0 | 0.2 | 0 | 0.05 | 0.1 |
| angry | 0.3 | 0 | 0.2 | 0 | 0.35 | | 0.05 | 0.1 | 0 | 0.05 | 0 |
| uneasiness | 0.2 | 0.1 | 0.8 | 0 | 0 | | 0.05 | 0.1 | 0 | 0 | 0 |

In comparison with other emotion paths, the final emotion path indicated by arrows in Table 10 has the highest sum of adjacent probability (1.0+0.3+0.3+0.7+ . . . ) and the highest sum of emotion score (0.2+0.4+0.8+1+0.3+ . . . ). The determination of final emotion path has to comprehensively consider emotion score of each word on one emotion category and adjacent probability of two emotion categories, in order to obtain the path with the highest possibility. The determination of final emotion path can be realized by a plurality of dynamic planning algorithms. For example, the above sum of adjacent probability and sum of emotion score can be weighted, in order to find an emotion path with highest probability after being summed and weighted as final emotion path.

Final emotion category of the rhythm piece is determined based on the final emotion path. Emotion score of the final emotion category then is obtained as final emotion score at step 505. For example, final emotion category of "Don't" is determined as "neutral" and the final emotion score is 0.2.

The determination of final emotion path can make expression of text data smoother and closer to the emotion state expressed during real reading. For example, if emotion smoothing process is not performed, final emotion category of "Don't" can be determined as "angry" instead of "neutral".

Generally, both the emotion smoothing process and the emotion vector adjustment described in FIG. 2B are used to determine the final emotion score and final emotion category of each rhythm piece. Such determination will result in text data TTS closer to real reading condition. However, their can emphasize different aspects.

The emotion vector adjustment emphasizes more on making emotion score comply with true semantic content, while emotion smoothing process emphasizes more on choosing an emotion category for smoothness and avoid abruptness.

As mentioned above, the present invention can further expand the emotion adjacent training data.

According to an embodiment of the present invention, the emotion adjacent training data is automatically expanded based on the formed final emotion path. For example, new emotion adjacent training data as shown in Table 11 below can be further derived from the final emotion path in Table 10, in order to realize expansion of emotion adjacent training data:

TABLE 11

| | | | | | | | | | | |
|---|---|---|---|---|---|---|---|---|---|---|
| Don't | feel | embarrassed | about | crying | . . . | sad | emotions | and | become | happy |
| neutral | neutral | uneasiness | neutral | sad | | sad | neutral | neutral | neutral | happy |

According to another embodiment of the present invention, the emotion adjacent training data is automatically expanded by connecting emotion category of the rhythm piece with the highest emotion score. In this embodiment, final emotion category of each rhythm piece is not determined based on final emotion path, but the emotion vector tagged in step 303 is analyzed to select an emotion category represented by highest emotion score in emotion vector. As a result, the process automatically expands the emotion adjacent training data. For example, if Table 1 describes emotion vectors tagged in step 303, then the new emotion adjacent training data derived from these emotion vectors shows expanded data. See Table 12:

TABLE 12

| | | | | | | | | | | |
|---|---|---|---|---|---|---|---|---|---|---|
| Don't | feel | embarrassed | about | crying | . . . | sad | emotions | and | become | happy |
| angry | neutral | uneasiness | neutral | angry | | sad | neutral | neutral | neutral | happy |

Since smoothing process is not performed on the emotion adjacent training data obtained in Table 12, some of its determined emotion categories (such as "Don't") can sometimes not comply with real emotion condition. However, in comparison with the expansion manner in Table 11, the computation load of the expansion manner in Table 12 is relative low.

The present invention does not exclude using more expansion manner to expand the emotion adjacent training data.

Next, achieving TTS is described in detail. It should be noted that the following embodiment for achieving TTS is applicable to step 307 in the embodiment shown in FIG. 3. The following embodiment is also applicable to step 105 in the embodiment shown in FIG. 1. Furthermore, the step of achieving TTS to the text data according to the emotion tag further includes the step of achieving TTS to the text data according to final emotion score and final emotion category of the rhythm piece. When achieving TTS, the present invention not only considers selected emotion category of one rhythm piece, but also considers final emotion score of final emotion category of one rhythm piece. As a result, the emotion feature of each rhythm piece can be fully embodied in TTS.

Figure 6A:
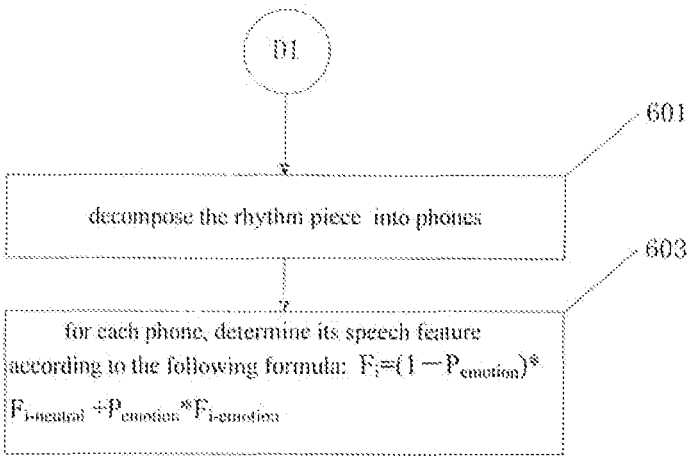
FIG. 6A shows a flowchart of a method for achieving TTS according to an embodiment of the present invention.

FIG. 6A shows a flowchart of a method for achieving TTS according to an embodiment of the present invention. At step 601, the rhythm piece is decomposed into phones. For example, for vocabulary "Embarrassed", according to its general language structure, it can be decomposed into 8 phones as shown in Table 13:

TABLE 13

| | | | | | | | |
|---|---|---|---|---|---|---|---|
| EH | M | B | AE | R | IH | S | T |

At step 603, for each phone in the number of phones, its speech feature is determined according to the following formula 2:

$$F_i=(1-P_{emotion})*F_{i\text{-}neutral}+P_{emotion}*F_{i\text{-}emotion} \quad \text{formula 2}$$

Where $F_i$ represents value of the $i^{th}$ speech feature of the phone, $P_{emotion}$ represents final emotion score of the rhythm piece where the phone lies, $F_{i\text{-}neutral}$ represents speech feature value of the $i^{th}$ speech feature in neutral emotion category, and $F_{i\text{-}emotion}$ represents speech feature value of the $i^{th}$ speech feature in the final emotion category.

For example, for vocabulary "embarrassed" in Table 10, its speech feature is:

$$F_i=(1-0.8)*F_{i\text{-}neutral}+0.8*F_{i\text{-}uneasiness}$$

The speech feature can be one or more of the following: basic frequency feature, frequency spectrum feature, time length feature. The basic frequency feature can be embodied as one or both of average value of basic frequency feature or variance of basic frequency feature. The frequency spectrum feature can be embodied as 24-dimension line spectrum frequency (LSF), i.e., representational frequencies in spectrum frequency. The 24-dimension line spectrum frequency (LSF) is a set of 24-dimension vector. The time length feature is the duration of that phone.

For each emotion category under each speech feature, there is pre-recorded corpus. For example, an announcer reads a large amount of text data that contain angry, sad, happy, emotion, and etc, and the audio is recorded into corresponding corpus. For a corpus of each emotion category under each speech feature, a TTS decision tree is established, where the TTS decision tree is typically a binary tree. The leaf node of the TTS decision tree records speech feature (including basic frequency feature, frequency spectrum feature or time length feature) that should be owned by each phone. The non-leaf node in the TTS decision tree can either be a series of problems regarding speech feature, or be an answer of "yes" or "no".

Figure 6B:
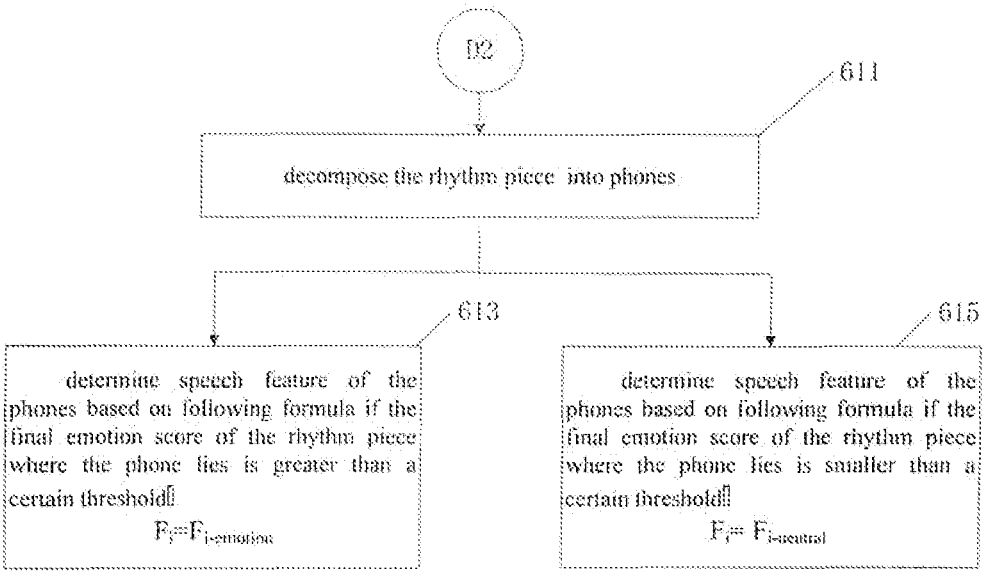
FIG. 6B shows a flowchart of a method for achieving TTS according to another embodiment of the present invention.
Figure 6C:
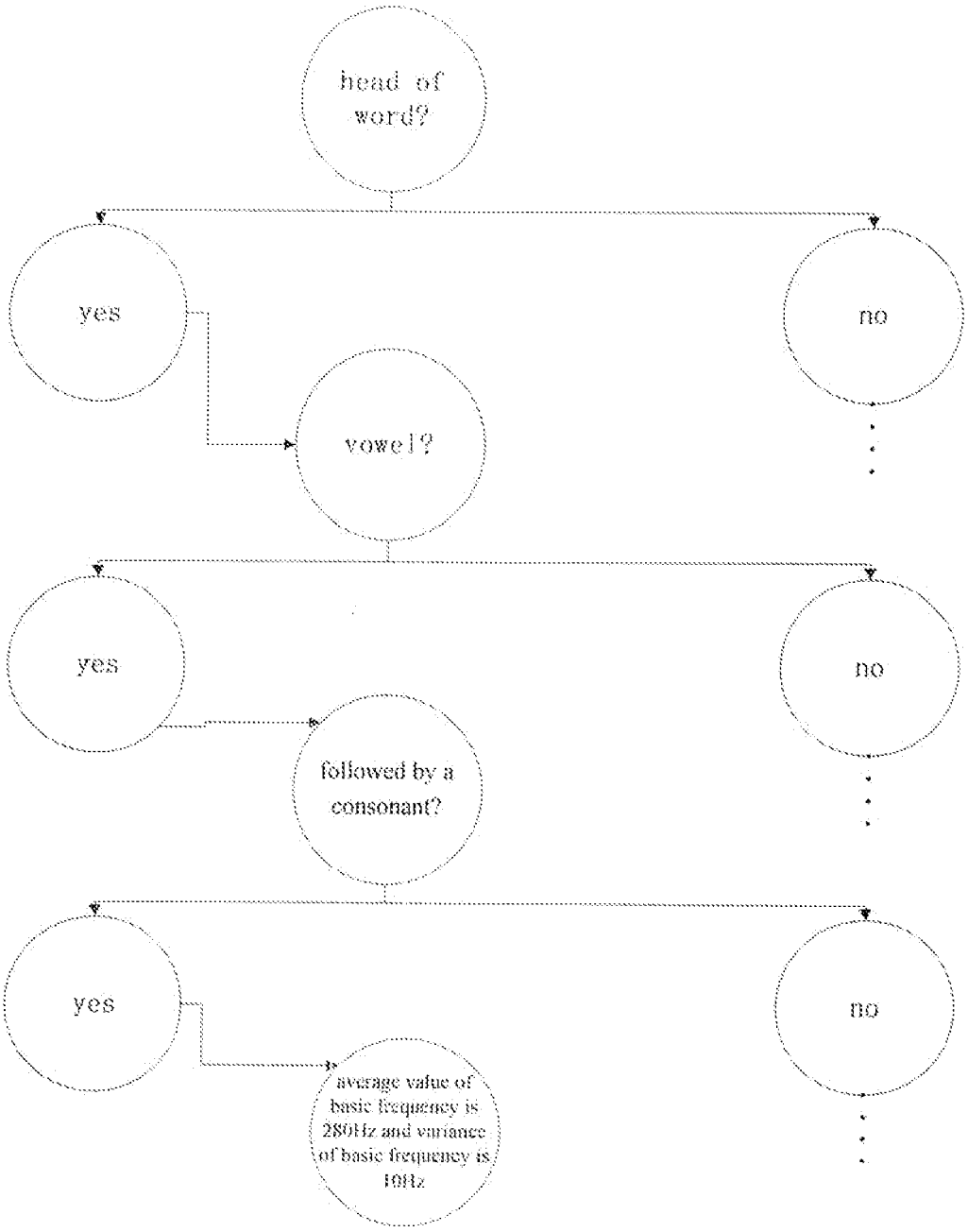
FIG. 6C is a diagram showing a fragment of an emotion vector adjustment decision tree under one emotion category with respect to basic frequency feature.

FIG. 6C shows a diagram of a fragment of a TTS decision tree under one emotion category with respect to basic frequency feature. The decision tree in FIG. 6C is obtained by traversing a corpus under one emotion category. Through making judgment on a series of problems, basic frequency feature of one phone can be recorded in corpus. For example, for one phone, it is first determined whether it is at the head of a word. If it is, it is then further determined whether the phone also contains a vowel. If not, other operations are performed. If the phone has a vowel, it is further determined whether the phone is followed by a consonant. If the phone is not followed by a consonant, it proceeds to perform other operations. If the phone is followed by a consonant, then basic frequency feature of that phone in corpus is recorded, including average value of basic frequency is 280 Hz and variance of basic frequency is 10 Hz. A large TTS decision tree can be constructed by automatically learning all sentences in the corpus.

FIG. 6C illustrates one fragment thereof. In addition, in the TTS decision tree, questions can be raised with respect to the following content and judgment can be made: the position of a phone in a syllable/vocabulary/rhythm phrase/sentence; the number of phones in current syllable/vocabulary/rhythm phrase; whether current/previous/next phone is vowel or consonant; articulation position of current/previous/next vowel phone; and vowel degree of current/previous/next vowel phone, which can includes a narrow vowel and a wide vowel; and etc. Once a TTS decision tree under one emotion category is established, one phone of one rhythm piece in text data can be entered, and basic frequency (e.g., $F_{i\text{-}uneasiness}$) of that phone under that emotion category can be determined through judgment on a series of problems. Similarly, both TTS decision tree relating to frequency spectrum feature and TTS decision tree relating to time length feature under each emotion category can also be constructed, in order to determine frequency spectrum feature and time length feature of that phone under certain emotion category.

Furthermore, the present invention can also divide a phone into several states, for example, divide a phone into 5 states and establish decision tree relating to each speech feature under each emotion category for the state, and query speech feature of one state of one phone of one rhythm piece in the text data through the decision tree.

However, the present invention is not simply limited to utilize the above method to obtain speech feature of phone under one emotion category to achieve TTS. According to an embodiment of the present invention, during TTS, not only final emotion category of the rhythm piece where a phone lies is considered, but also the final emotion category's corresponding final emotion score (such as $P_{emotion}$ in formula 2) is considered. It can be seen from formula 2 that the larger the final emotion score is the closer the $i^{th}$ speech feature value of the phone than to the speech feature value of one final emotion category. In contrast, the smaller the final emotion score is, the closer the $i^{th}$ speech feature value of the phone than to speech feature value under "neutral" emotion category. The formula 2 further makes the process of TTS smoother, and avoids abrupt and unnatural TTS effect due to emotion category jump.

Of course, there can be various variations to the TTS method shown in formula 2. For example, FIG. 6B shows a flowchart of a method for achieving TTS according to another embodiment of the present invention. The rhythm piece is decomposed into phones at step 611. Speech feature of the phones are determined based on following formula if the final emotion score of the rhythm piece where the phone lies is greater than a certain threshold (step 613):

$$F_i = F_{i\text{-}emotion}$$

Speech feature of the phones are determined based on following formula if the final emotion score of the rhythm piece where the phone lies is smaller than a certain threshold (step 615):

$$F_i = F_{i\text{-}neutral}$$

For above two formulas, $F_i$ represents value of the $i^{th}$ speech feature of the phone, $F_{i\text{-}neutral}$ represents speech feature value of the $i^{th}$ speech feature in neutral emotion category, $F_{i\text{-}emotion}$ represents speech feature value of the $i^{th}$ speech feature in the final emotion category.

In practice, the present invention is not only limited to the implementation shown in FIGS. 6A and 6B, it further includes other manners for achieving TTS.

Figure 7:
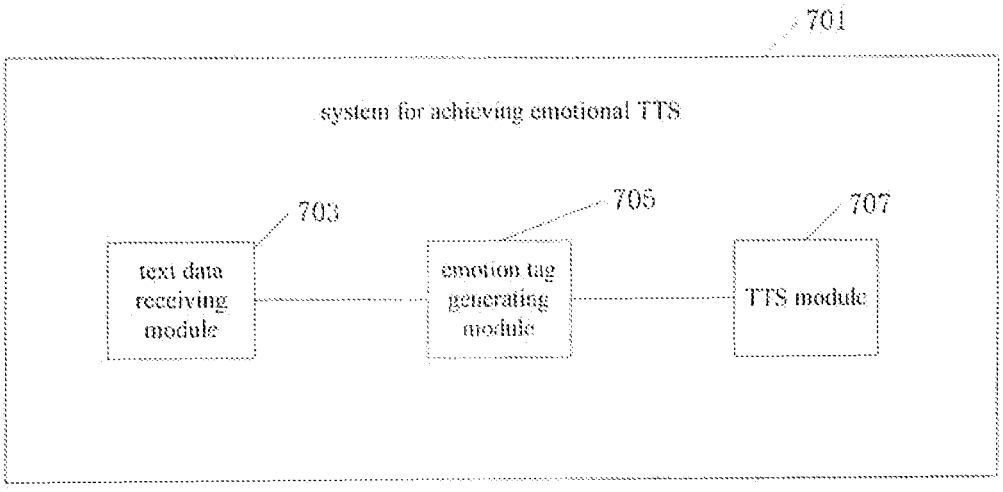
FIG. 7 shows a block diagram of a system for achieving emotional TTS according to an embodiment of the present invention.

FIG. 7 shows a block diagram of a system for achieving emotional TTS according to an embodiment of the present invention. The system 701 for achieving emotional TTS in FIG. 7 includes: a text data receiving module 703 for receiving text data; an emotion tag generating module 705 for generating an emotion tag for the text data by rhythm piece, where the emotion tag are expressed as a set of emotion vector, and where the emotion vector includes plurality of emotion scores given based on multiple emotion categories; and a TTS module 707 for achieving TTS to the text data according to the emotion tag.

Figure 8A:
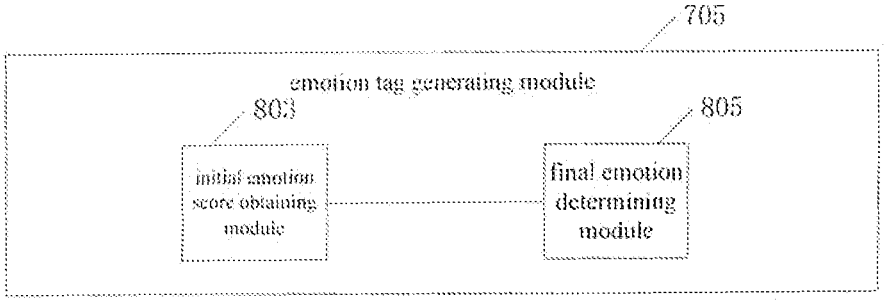
FIG. 8A shows a block diagram of an emotion tag generating module according to an embodiment of the present invention.

FIG. 8A shows a block diagram of an emotion tag generating module 705 according to an embodiment of the present invention. The emotion tag generating module 705 further includes: an initial emotion score obtaining module 803 for obtaining initial emotion score of each emotion category corresponding to the rhythm piece; and a final emotion determining module 805 for determining a highest value in the plurality of emotion scores as final emotion score and taking emotion category represented by the final emotion score as final emotion category.

Figure 8B:
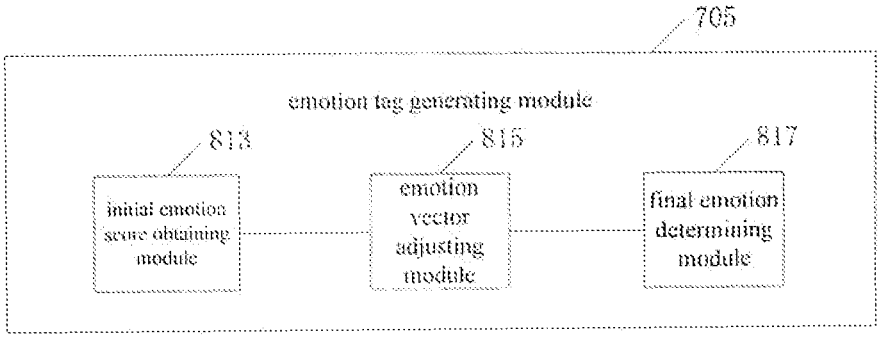
FIG. 8B shows a block diagram of an emotion tag generating module according to another embodiment of the present invention.

FIG. 8B shows a block diagram of an emotion tag generating module 705 according to another embodiment of the present invention. The emotion tag generating module 705 further includes: an initial emotion score obtaining module 813 for obtaining initial emotion score of each emotion category corresponding to the rhythm piece; an emotion vector adjusting module 815 for adjusting the emotion vector according to a context of the rhythm piece; and a final emotion determining module 817 for determining a highest value in the adjusted plurality of emotion scores as final emotion score and taking emotion category represented by the final emotion score as final emotion category.

Figure 9:
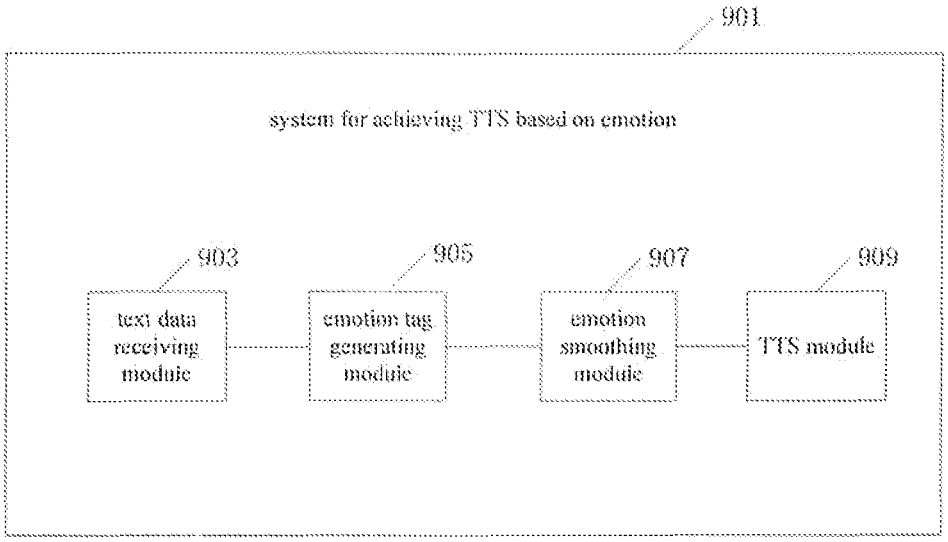
FIG. 9 shows a block diagram of a system for achieving emotional TTS according to another embodiment of the present invention.

FIG. 9 shows a block diagram of a system 901 for achieving emotional TTS according to another embodiment of the present invention. The system 901 for achieving emotional TTS includes: a text data receiving module 903 for receiving text data; an emotion tag generating module 905 for generating emotion tag for the text data by rhythm piece, where the emotion tag are expressed as a set of emotion vector, the emotion vector includes plurality of emotion scores given based on multiple emotion categories; an emotion smoothing module 907 for applying emotion smoothing to the text data based on the emotion tag of the rhythm piece; and a TTS module 909 for achieving TTS to the text data according to the emotion tag.

Furthermore, the TTS module 909 is further for achieving TTS to the text data according to the final emotion score and final emotion category of the rhythm piece.

Figure 10:
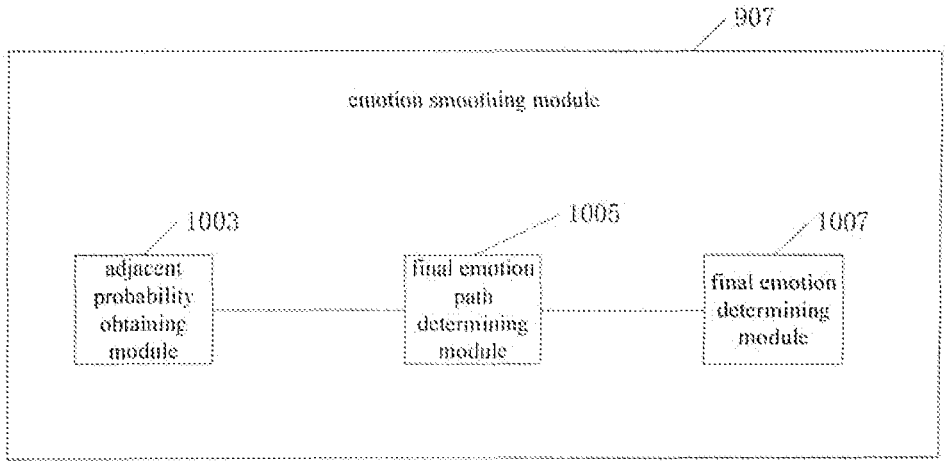
FIG. 10 shows a block diagram of an emotion smoothing module in FIG. 9 according to an embodiment of the present invention.

FIG. 10 shows a block diagram of an emotion smoothing module 907 in FIG. 9 according to an embodiment of the present invention. The emotion smoothing module 907 includes: an adjacent probability obtaining module 1003 for obtaining, for one emotion category of at least one rhythm piece, adjacent probability that its emotion is connecting to one emotion category of another rhythm piece; a final emotion path determining module 1005 for determining final emotion path of the text data based on the adjacent probability and emotion scores of respective emotion categories; and a final emotion determining module 1007 for determining final emotion category of the rhythm piece based on the final emotion path and obtaining emotion score of the final emotion category as final emotion score.

The functional flowchart performed and completed by respective modules in FIG. 7-FIG. 10 have been described in detail above, and one can refer to the detailed description of FIG. 1-6C will not be described here for brevity.

The above and other features of the present invention will become more distinct by a detailed description of embodiments shown in combination with attached drawings. Identical reference numbers represent the same or similar parts in the attached drawings of the invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer. Aspects of the present invention are described below with reference to flowchart illustrations and/or block diagrams of methods, apparatus (systems) and computer program products according to embodiments of the invention.

It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams can represent a module, segment, or portion of code, which includes one or more executable instructions for implementing the specified logical function(s).

It should also be noted that, in some alternative implementations, the functions noted in the block can occur out of the order noted in the figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A method for achieving emotional Text To Speech (TTS), the method comprising:

receiving a set of text data;

organizing each of a plurality of words in the set of text data into a plurality of rhythm pieces;

generating an emotion tag for each of the plurality of rhythm pieces, wherein each emotion tag is expressed as a set of emotion vectors, each emotion vector comprising a plurality of emotion scores, where each of the plurality of emotion scores is assigned to a different emotion category in a plurality of emotion categories;

determining, for each of the plurality of rhythm pieces, a final emotion score for the rhythm piece based on at least each of the plurality of emotion scores;

determining, for each of the plurality of rhythm pieces, a final emotional category for the rhythm piece based on at least each of the plurality of emotion categories; and performing, by at least one processor of at least one computing device, TTS of the set of text data utilizing each of the emotion tags, where performing TTS comprises decomposing at least one rhythm piece in the plurality of rhythm pieces into a set of phones; and determining for each of the set of phones a speech feature based on:

$$F_i=(1-P_{emotion})*F_{i\text{-}neutral}+P_{emotion}*F_{i\text{-}emotion}$$

wherein:

$F_i$ is a value of an $i^{th}$ speech feature of one of the plurality of phones, $P_{emotion}$ is the final emotion score of the rhythm piece where one of the plurality of phones lies, $F_{i\text{-}neutral}$ is a first speech feature value of an $i^{th}$ speech feature in a neutral emotion category, and $F_{i\text{-}emotion}$ is a second speech feature value of an $i^{th}$ speech feature in the final emotion category.

2. The method according to claim 1, wherein determining the final emotion score comprises:

designating the final emotion score as an emotion score in the plurality of emotion scores comprising.

3. The method according to claim 1, further comprising:

adjusting, for at least one of the plurality of rhythm pieces, at least one emotion score in the plurality of emotion scores according to a context of the rhythm piece; and determining the final emotion score and the final emotion category of the rhythm piece based on the plurality of emotion scores comprising the at least one emotion score that has been adjusted.

4. The method according to claim 3, wherein adjusting the at least one emotion score further comprises:

adjusting the at least one emotion score based on an emotion vector adjustment decision tree, wherein the emotion vector adjustment decision tree is established based on emotion vector adjustment training data.

5. The method according to claim 1, further comprising:

applying emotion smoothing to the set of text data based on the emotion tags generated for the plurality of rhythm pieces.

6. The method according to claim 5, wherein applying emotion smoothing comprises:

obtaining an adjacent probability that a first emotion category associated with a first of the plurality of rhythm pieces is connected to a second emotion category of a second of the plurality of rhythm pieces that is adjacent to the first of the plurality of rhythm pieces;

determining a final emotion path of the set of text data based on the adjacent probability and a plurality of emotion scores of corresponding emotion categories; and determining the final emotion category of each of the plurality of rhythm pieces based on the final emotion path.

7. The method according to claim 6, further comprising:

determining the final emotion score from the final emotion category, wherein the final emotion score has a highest value in the plurality of emotion scores.

8. The method according to claim 6, wherein obtaining an adjacent probability further comprises:

performing a statistical analysis on emotion adjacent training data, wherein the statistical analysis records a number of times where at least two of the plurality of emotion categories had been adjacent in the emotion adjacent training data.

9. The method according to claim 8, further comprising:

expanding the emotion adjacent training data based on the formed final emotion path.

10. The method according to claim 8, further comprising:

expanding the emotion adjacent training data by connecting at least one of the plurality of emotion categories with a highest value in the plurality of emotion scores.

11. The method according to claim 1, wherein determining for each of the set of phones a speech feature further comprises:

determining if the final emotion score of the rhythm piece where the phone lies is greater than a certain threshold, based on:

$$F_i=F_{i\text{-}emotion}.$$

12. The method according to claim 1, wherein determining for each of the set of phones a speech feature further comprises:

determining if the final emotion score of the rhythm piece where one the phone lies is smaller than a certain threshold, based on:

$$F_i=F_{i\text{-}neutral}.$$

13. The method according to claim 1, wherein the speech feature comprises at least one of:

a basic frequency feature, a frequency spectrum feature, a time length feature, and a combination thereof.

14. A system for achieving emotional Text To Speech (TTS), comprising:

at least one memory; and at least one processor communicatively coupled to the at least one memory, the at least one processor configured to perform a method comprising:

receiving a set of text data;

organizing the set of text data into a plurality of rhythm pieces;

generating an emotion tag for each of the plurality of rhythm pieces, wherein each emotion tag is expressed as a set of emotion vectors, each emotion vector comprising a plurality of emotion scores, where each of the plurality of emotion scores is assigned to a different emotion category in a plurality of emotion categories;

determining, for each of the plurality of rhythm pieces, a final emotion score for the rhythm piece based on at least each of the plurality of emotion scores;

determining, for each of the plurality of rhythm pieces, a final emotional category for the rhythm piece based on at least each of the plurality of emotion categories; and performing, TTS of the set of text data utilizing each of the emotion tags, where performing TTS comprises decomposing at least one rhythm piece in the plurality of rhythm pieces into a set of phones; and determining for each of the set of phones a speech feature based on:

$$F_i=(1-P_{emotion})*F_{i\text{-}neutral}+P_{emotion}*F_{i\text{-}emotion}$$

wherein:

$F_i$ is a value of an $i^{th}$ speech feature of one of the plurality of phones, $P_{emotion}$ is the final emotion score of the rhythm piece where one of the plurality of phones lies, $F_{i\text{-}neutral}$ is a first speech feature value of an $i^{th}$ speech feature in a neutral emotion category, and $F_{i\text{-}emotion}$ is a second speech feature value of an $i^{th}$ speech feature in the final emotion category.

15. The system of claim 14, wherein determining the final emotion score comprises:

designating the final emotion score as an emotion score in the plurality of emotion scores comprising a highest value.

16. The system of claim 14, wherein the method further comprises:

adjusting, for at least one of the plurality of rhythm pieces, at least one emotion score in the plurality of emotion scores according to a context of the rhythm piece; and determining the final emotion score and the final emotion category of the rhythm piece based on the plurality of emotion scores comprising the at least one emotion score that has been adjusted.

17. The system of claim 14, wherein the method further comprises:

applying emotion smoothing to the set of text data based on the emotion tags generated for the plurality of rhythm pieces.

18. The system of claim 17, wherein applying emotion smoothing further comprises:

obtaining an adjacent probability that a first emotion category associated with a first of the plurality of rhythm pieces is connected to a second emotion category of a second of the plurality of rhythm pieces that is adjacent to the first of the plurality of rhythm pieces;

determining a final emotion path of the set of text data based on the adjacent probability and a plurality of emotion scores of corresponding emotion categories; and determining the final emotion category of each of the plurality of rhythm pieces based on the final emotion path.

* * * * *